US007179155B2

(12) United States Patent
Shin et al.

(10) Patent No.: US 7,179,155 B2
(45) Date of Patent: Feb. 20, 2007

(54) DEVICE FOR GRINDING LIQUID CRYSTAL DISPLAY PANEL

(75) Inventors: Sang-Sun Shin, Kyoungsangbuk-Do (KR); Jong-Go Lim, Kyoungsangbok-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/851,176

(22) Filed: May 24, 2004

(65) Prior Publication Data

US 2004/0224609 A1 Nov. 11, 2004

Related U.S. Application Data

(63) Continuation of application No. 10/327,085, filed on Dec. 24, 2002, now Pat. No. 6,755,724.

(30) Foreign Application Priority Data

Mar. 21, 2002 (KR) ..... 10-2002-0015452

(51) Int. Cl.
*B24B 7/00* (2006.01)
*B24B 9/00* (2006.01)

(52) U.S. Cl. ..... 451/65; 451/28; 451/41; 451/44; 451/64; 451/178; 451/190; 451/194; 451/261; 451/262; 451/364; 451/368; 451/388

(58) Field of Classification Search ..... 451/28, 451/41, 44, 64, 178, 190, 194, 261, 262, 451/364, 368, 388
See application file for complete search history.

(56) References Cited

U.S. PATENT DOCUMENTS 3,978,580 A 9/1976 Leupp et al.
4,094,058 A 6/1978 Yasutake et al.
4,653,864 A 3/1987 Baron et al.
4,685,180 A * 8/1987 Kitaya et al. ..... 29/33
4,691,995 A 9/1987 Yamazaki et al.
4,775,225 A 10/1988 Tsuboyama et al.
5,247,377 A 9/1993 Omeis et al.
5,263,888 A 11/1993 Ishihara et al.
5,379,139 A 1/1995 Sato et al.
5,406,989 A 4/1995 Abe (Continued)

FOREIGN PATENT DOCUMENTS

EP 1 003 066 A1 A1 5/2000

(Continued)

*Primary Examiner*—Joseph J. Hail, III
*Assistant Examiner*—Shantese L. McDonald
(74) *Attorney, Agent, or Firm*—McKenna Long & Aldridge LLP

(57) ABSTRACT

Disclosed is a device for grinding a liquid crystal display panel improving the efficiency of using equipment by independently operating first and second grinding units for grinding the unit liquid crystal display panel. The present invention includes a first grinding unit grinding edges of short or long sides of the unit liquid crystal display panel in a normal mode and a second grinding unit grinding the edges of the short or long sides of the unit liquid crystal display panel that are not ground by the first grinding unit in the normal mode or grinding the edges of the long and short sides of the unit liquid crystal display panel in an emergency mode.

15 Claims, 6 Drawing Sheets

U.S. PATENT DOCUMENTS

| | | | | |
|---|---|---|---|---|
| 5,499,128 | A | 3/1996 | Hasegawa et al. | |
| 5,507,323 | A | 4/1996 | Abe | |
| 5,511,591 | A | 4/1996 | Abe | |
| 5,539,545 | A | 7/1996 | Shimizu et al. | |
| 5,548,429 | A | 8/1996 | Tsujita | |
| 5,642,214 | A | 6/1997 | Ishii et al. | |
| 5,680,189 | A | 10/1997 | Shimizu et al. | |
| 5,742,370 | A | 4/1998 | Kim et al. | |
| 5,757,451 | A | 5/1998 | Miyazaki et al. | |
| 5,852,484 | A | 12/1998 | Inoue et al. | |
| 5,854,664 | A | 12/1998 | Inoue et al. | |
| 5,861,932 | A | 1/1999 | Inata et al. | |
| 5,875,922 | A | 3/1999 | Chastine et al. | |
| 5,952,676 | A | 9/1999 | Sato et al. | |
| 5,956,112 | A | 9/1999 | Fujimori et al. | |
| 6,001,203 | A | 12/1999 | Yamada et al. | |
| 6,011,609 | A | 1/2000 | Kato et al. | |
| 6,016,178 | A | 1/2000 | Kataoka et al. | |
| 6,016,181 | A | 1/2000 | Shimada | |
| 6,055,035 | A | 4/2000 | von Gutfeld et al. | |
| 6,163,357 | A | 12/2000 | Nakamura | |
| 6,219,126 | B1 | 4/2001 | von Gutfeld | |
| 6,226,067 | B1 | 5/2001 | Nishiguchi et al. | |
| 6,236,445 | B1 | 5/2001 | Foschaar et al. | |
| 6,304,306 | B1 | 10/2001 | Shiomi et al. | |
| 6,304,311 | B1 | 10/2001 | Egami et al. | |
| 6,319,100 | B1 * | 11/2001 | Denda et al. | 451/65 |
| 6,325,704 | B1 * | 12/2001 | Brown et al. | 451/44 |
| 6,337,730 | B1 | 1/2002 | Ozaki et al. | |
| 6,361,867 | B2 * | 3/2002 | Kishida et al. | 428/428 |
| 6,414,733 | B1 | 7/2002 | Ishikawa et al. | |
| 6,565,421 | B1 * | 5/2003 | Choo | 451/41 |
| 2001/0021000 | A1 | 9/2001 | Egami | |

FOREIGN PATENT DOCUMENTS

| | | | |
|---|---|---|---|
| JP | 51-065656- | | 6/1976 |
| JP | 57-038414 | A1 | 3/1982 |
| JP | 57-066845 | | 4/1982 |
| JP | 57-088428 | A1 | 6/1982 |
| JP | 58-027126 | A1 | 2/1983 |
| JP | 59-057221- | | 4/1984 |
| JP | 59-195222- | | 11/1984 |
| JP | 60-111221- | | 6/1985 |
| JP | 60-164723 | A1 | 8/1985 |
| JP | 60-217343 | A1 | 10/1985 |
| JP | 61-007822 | A1 | 1/1986 |
| JP | 61-055625 | A1 | 3/1986 |
| JP | 62-089025 | A1 | 4/1987 |
| JP | 62-090622 | A1 | 4/1987 |
| JP | 62-205319 | A1 | 9/1987 |
| JP | 63-109413 | A1 | 5/1988 |
| JP | 63-110425 | A1 | 5/1988 |
| JP | 63-128315 | A1 | 5/1988 |
| JP | 63-311233 | A1 | 12/1988 |
| JP | 05-127179 | A1 | 5/1993 |
| JP | 05-154923- | | 6/1993 |
| JP | 05-265011 | A1 | 10/1993 |
| JP | 05-281557 | A1 | 10/1993 |
| JP | 05-281562 | A1 | 10/1993 |
| JP | 06-051256 | A1 | 2/1994 |
| JP | 06-148657 | A1 | 5/1994 |
| JP | 06-160871- | | 6/1994 |
| JP | 06-235925- | | 8/1994 |
| JP | 06-265915 | A1 | 9/1994 |
| JP | 06-313870- | | 11/1994 |
| JP | 07-084268- | | 3/1995 |
| JP | 07-128674 | A1 | 5/1995 |
| JP | 07-181507 | A1 | 7/1995 |
| JP | 08-095066 | A1 | 4/1996 |
| JP | 08-101395- | | 4/1996 |
| JP | 08-106101 | A1 | 4/1996 |
| JP | 08-171094 | A1 | 7/1996 |
| JP | 08-190099 | A1 | 7/1996 |
| JP | 08-197402 | | 8/1996 |
| JP | 08-240807 | A1 | 9/1996 |
| JP | 09-005762 | A1 | 1/1997 |
| JP | 09-026578 | A1 | 1/1997 |
| JP | 09-061829- | | 3/1997 |
| JP | 09-073075 | A1 | 3/1997 |
| JP | 09-073096 | A1 | 3/1997 |
| JP | 09-127528 | A1 | 5/1997 |
| JP | 09-230357 | A1 | 9/1997 |
| JP | 09-281511 | A1 | 10/1997 |
| JP | 09-311340 | A1 | 12/1997 |
| JP | 10-123537 | A1 | 5/1998 |
| JP | 10-123538 | A1 | 5/1998 |
| JP | 10-142616 | A1 | 5/1998 |
| JP | 10-177178- | | 6/1998 |
| JP | 10-221700 | A1 | 8/1998 |
| JP | 10-282512 | A1 | 10/1998 |
| JP | 10-333157- | | 12/1998 |
| JP | 10-333159- | | 12/1998 |
| JP | 11-014953 | A1 | 1/1999 |
| JP | 11-038424 | A1 | 2/1999 |
| JP | 11-064811 | A1 | 3/1999 |
| JP | 11-109388 | A1 | 4/1999 |
| JP | 11-133438- | | 5/1999 |
| JP | 11-142864- | | 5/1999 |
| JP | 11-174477 | A1 | 7/1999 |
| JP | 11-212045 | A1 | 8/1999 |
| JP | 11-248930- | | 9/1999 |
| JP | 11-326922- | | 11/1999 |
| JP | 11-344714 | A1 | 12/1999 |
| JP | 2000-002879- | | 1/2000 |
| JP | 2000-029035- | | 1/2000 |
| JP | 2000-056311- | | 2/2000 |
| JP | 2000-066165- | | 3/2000 |
| JP | 2000-137235- | | 5/2000 |
| JP | 2000-147528- | | 5/2000 |
| JP | 2000-193988- | | 7/2000 |
| JP | 2000-241824- | | 9/2000 |
| JP | 2000-284295- | | 10/2000 |
| JP | 2000-292799- | | 10/2000 |
| JP | 2000-310759- | | 11/2000 |
| JP | 2000-310784- | | 11/2000 |
| JP | 2000-338501- | | 12/2000 |
| JP | 2001-005401- | | 1/2001 |
| JP | 2001-005405- | | 1/2001 |
| JP | 2001-013506- | | 1/2001 |
| JP | 2001-033793 | A1 | 2/2001 |
| JP | 2001-042341- | | 2/2001 |
| JP | 2001-051284- | | 2/2001 |
| JP | 2001-066615- | | 3/2001 |
| JP | 2001-091727- | | 4/2001 |
| JP | 2001-117105- | | 4/2001 |
| JP | 2001-117109- | | 4/2001 |
| JP | 2001-133745- | | 5/2001 |
| JP | 2001-133794- | | 5/2001 |
| JP | 2001-133799- | | 5/2001 |
| JP | 2001-142074- | | 5/2001 |
| JP | 2001-147437- | | 5/2001 |
| JP | 2001-154211- | | 6/2001 |
| JP | 2001-166272- | | 6/2001 |
| JP | 2001-166310- | | 6/2001 |
| JP | 2001-183683- | | 7/2001 |
| JP | 2001-209052- | | 8/2001 |
| JP | 2001-209060- | | 8/2001 |
| JP | 2001-222017- | | 8/2001 |
| JP | 2001-235758- | | 8/2001 |
| JP | 2001-215459- | | 9/2001 |
| JP | 2001-255542- | | 9/2001 |
| JP | 2001-264782- | | 9/2001 |
| JP | 2001-201750- | | 10/2001 |

| | | | |
|---|---|---|---|
| JP | 2001-272640- | | 10/2001 |
| JP | 2001-281675- | | 10/2001 |
| JP | 2001-281678- | | 10/2001 |
| JP | 2001-282126- | | 10/2001 |
| JP | 2001-305563- | | 10/2001 |
| JP | 2001-330837- | | 11/2001 |
| JP | 2001-330840 | A1 | 11/2001 |
| JP | 2001-356353- | | 12/2001 |
| JP | 2001-356354 | A1 | 12/2001 |
| JP | 2002-014360 | A1 | 1/2002 |
| JP | 2002-023176 | A1 | 1/2002 |
| JP | 2002-049045 | A1 | 2/2002 |
| JP | 2002-082340 | A1 | 3/2002 |
| JP | 2002-090759 | A1 | 3/2002 |
| JP | 2002-090760 | A1 | 3/2002 |
| JP | 2002-107740 | A1 | 4/2002 |
| JP | 2002-122872 | A1 | 4/2002 |
| JP | 2002-122873 | A1 | 4/2002 |
| JP | 2002-139734- | | 5/2002 |
| JP | 2002-202512 | A1 | 7/2002 |
| JP | 2002-202514 | A1 | 7/2002 |
| JP | 2002-214626 | A1 | 7/2002 |
| KR | 2000-035302 | A1 | 6/2000 |

* cited by examiner

DEVICE FOR GRINDING LIQUID CRYSTAL DISPLAY PANEL

This application is a continuation of U.S. patent application Ser. No. 10/327,085 filed Dec. 24, 2002 now U.S. Pat. No. 6,755,724.

This application claim the benefit of the Korean Patent Application No. P2002-15452 filed on Mar. 21, 2002, which is hereby incorporated by reference for all purposes as if fully set forth herein.

BACKGROUND OF THE INVENTION

1. Field of the Invention

The present invention relates to a device for grinding a liquid crystal display panel, and, more particularly, a device that grinds edges of a unit liquid crystal display panel after liquid crystal display panels fabricated on a pair of wide mother substrates are cut into individual unit liquid crystal display panels.

2. Background of the Related Art

Generally, in a liquid crystal display device, data signals are supplied to liquid crystal cells arranged in a matrix according to image information to display a demanded image by controlling a light-transmittance of each of the liquid crystal cells.

The process of cutting a large mother substrate into unit liquid crystal display panels generally includes a process of forming a scribing line on a substrate of a mother substrate using a pen having a hardness greater than that of glass and a process of propagating a crack along the scribing line. Such a cutting process of the unit panels is explained in detail by referring to the attached drawings.

FIG. 1 illustrates a cross-sectional view of a first mother substrate having thin film transistor array substrates and a second mother substrate having color filter substrates, in which the first and second mother substrates are bonded to each other to construct a plurality of liquid crystal display panels.

Referring to FIG. 1, in unit liquid crystal display panels, each of thin film transistor array substrates 1 has one side protruding longer than that of each of corresponding color filter substrates 2. This is because gate and data pad parts(not shown in the drawing) are formed at the corresponding edges of the thin film transistor array substrate 1 that are not overlapped by the color filter substrate 2.

Hence, the color filter substrates 2 on the second mother substrate 30 are separated from each other by a dummy area 31 that corresponds to the area of each of the thin film transistor array substrates 1 on the first mother substrate 20 that does not overlap the color filter substrate 2.

Moreover, the unit liquid crystal display panels are arranged properly to make best use of the first and second mother substrates 20 and 30. Depending on the models being fabricated, the unit liquid crystal display panels are generally formed to be separated from each other by an area of another dummy area 32.

After the first mother substrate having the thin film transistor array substrates 1 has been bonded to the second mother substrate 30 having the color filter substrates 2, the liquid crystal display panels are individually cut. In this case, the dummy area 31 of each of the color filter substrates 2 of the second mother substrate 30 and the other dummy area 32 separating the unit liquid crystal display panels from each other are removed simultaneously.

FIG. 2 illustrates a schematic layout of an individually cut unit liquid crystal display panel according to a related art.

Referring to FIG. 2, a unit liquid crystal display panel 10 includes an image display part 13 having liquid crystal cells arranged in a matrix form, a gate pad part 14 connecting gate lines GLN~GLm of the image display part 13 to a gate driver integrated circuit(not shown in the drawing) for supplying gate signals, and a data pad part 15 connecting data lines DL1~DLn of the image display part 13 to a data driver integrated circuit(not shown in the drawing) for supplying image information. In this case, the gate and data pad parts 14 and 15 are formed on edge areas of a thin film transistor array substrate 1 having long sides and short sides protruding longer than those of a color filter substrate 2.

In this case, the data and gate lines DL1~DLn and GL1~GLm cross each other on the thin film transistor array substrate 1. Thin film transistors (TFTs) are formed at the crossings of the gate and data lines to switch respective liquid crystal cells. Pixel electrodes are connected to the thin film transistors to apply electric fields to the corresponding liquid crystal cells, and a passivation layer is formed on an entire surface to protect the data lines DL1~DLn, gate lines GL1~GLm, thin film transistors, and electrodes.

Color filters are formed on the color filter substrate 2 and are separated from adjacent cells by a black matrix. A common electrode is also formed on the color filter substrate 2 as a counter electrode of the pixel electrodes on the thin film transistor array substrate 1.

A cell gap is provided between thin film transistor array and color filter substrates 1 and 2, which face each other, to leave a predetermined interval between them. The thin film transistor array and color filter substrates 1 and 2 are bonded to each other by a sealing part (not shown in the drawing) formed on a periphery of the image display part 13. A liquid crystal layer (not shown in the drawing) is formed in the cell gap.

Meanwhile, a short-circuiting line number (not shown in the drawing) is formed on an edge of the thin film transistor array substrate 1 in order to prevent static electricity generated by the patterned conductive layers on the thin film transistor array substrate 1.

The short-circuiting line should be removed after the liquid crystal display panels are cut into individual unit liquid crystal display panels.

Hence, after the liquid crystal display panels have been cut into individual unit liquid crystal display panels, edges of the unit liquid crystal display panel are ground to remove the short-circuiting line. Moreover, the edges of the unit liquid crystal display panel are ground to prevent the edges from being torn apart by an external impact as well as the danger of hurting an operator with the sharp edges of the unit liquid crystal display panel.

A process of grinding the above-explained unit liquid crystal display panel is explained in detail by referring to the attached drawing as follows.

FIG. 3 illustrates a block diagram of a device for grinding a liquid crystal display panel according to a related art.

Referring to FIG. 3, a device for grinding a liquid crystal display panel according to a related art includes a loading unit 50 for loading a unit liquid crystal display panel 10, a first grinding unit 53 for receiving the unit liquid crystal display panel 10 loaded by the loading unit 50 on a first grinding table 51 and for grinding short sides of the unit liquid crystal display panel 10 through a first grinding wheel 52, a turning unit 54 for turning the unit liquid crystal display panel 10 by 90° after its short sides have been ground, a second grinding unit 57 for receiving the turned unit liquid crystal display panel 10 on a second grinding table 55 and for grinding long sides of the unit liquid crystal display panel 10 through a second grinding wheel 56, an unloading unit 58 for receiving to unload the unit liquid crystal display panel 10 after its long sides have been ground.

Thus, in order to grind the edges of the unit liquid crystal display panel 10 in the device for grinding the liquid crystal display panel according to the related art, the first grinding unit 53 grinds the short sides of the unit liquid crystal display panel 10; then, the turning unit 54 turns the unit liquid crystal display panel 10 having the grinded short sides by 90°, and the second grinding unit 57 grinds the long sides of the unit liquid crystal display panel 10.

As mentioned in the foregoing explanation, in order to grind the edges of the unit liquid crystal display panel, the device for grinding the liquid crystal display panel according to the related art has the first grinding unit grind the short sides of the unit liquid crystal display panel and has the second grinding unit grind the long sides of the unit liquid crystal display panel. If the first or second grinding unit is broken or malfunctions, the related art grinding device cannot grind all edges of the unit liquid crystal display panel until it is fixed. Hence, the device for grinding the liquid crystal display panel according to the related art has a reduced efficiency thereby decreasing productivity.

SUMMARY OF THE INVENTION

Accordingly, the present invention is directed to a device for grinding a liquid crystal display panel that substantially obviates one or more problems due to limitations and disadvantages of the related art.

An advantage of the present invention is to provide a device for grinding a liquid crystal display panel to improve an equipment using efficiency by independently operating first and second grinding units for grinding the unit liquid crystal display panel.

Additional advantages and features of the invention will be set forth in part in the description that follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, a device for grinding a liquid crystal display panel according to the present invention includes a first grinding unit for grinding edges of one of short and long sides of the unit liquid crystal display panel in a normal mode and a second grinding unit for grinding the edges of the other of the short and long sides of the unit liquid crystal display panel and for grinding the edges of the long and short sides of the unit liquid crystal display panel in an emergency mode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principles of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
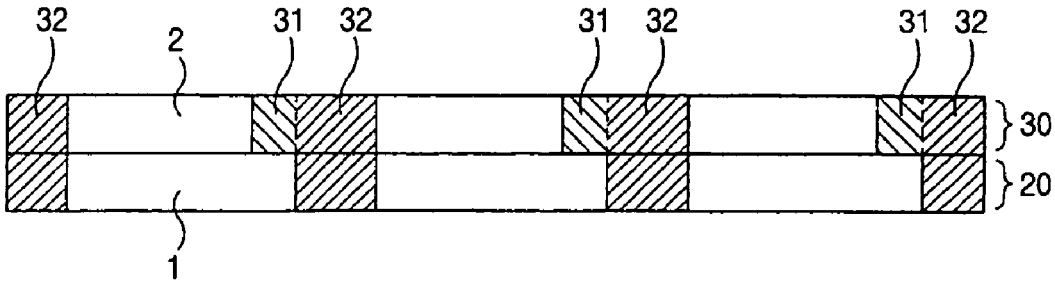
FIG.1 RELATED ART
FIG. 1 illustrates a cross-sectional view of a first mother substrate having thin film transistor array substrates and a second mother substrate having color filter substrates according to a related art, in which the first and second mother substrates are bonded to each other to construct a plurality of unit liquid crystal display panels.
Figure 2:
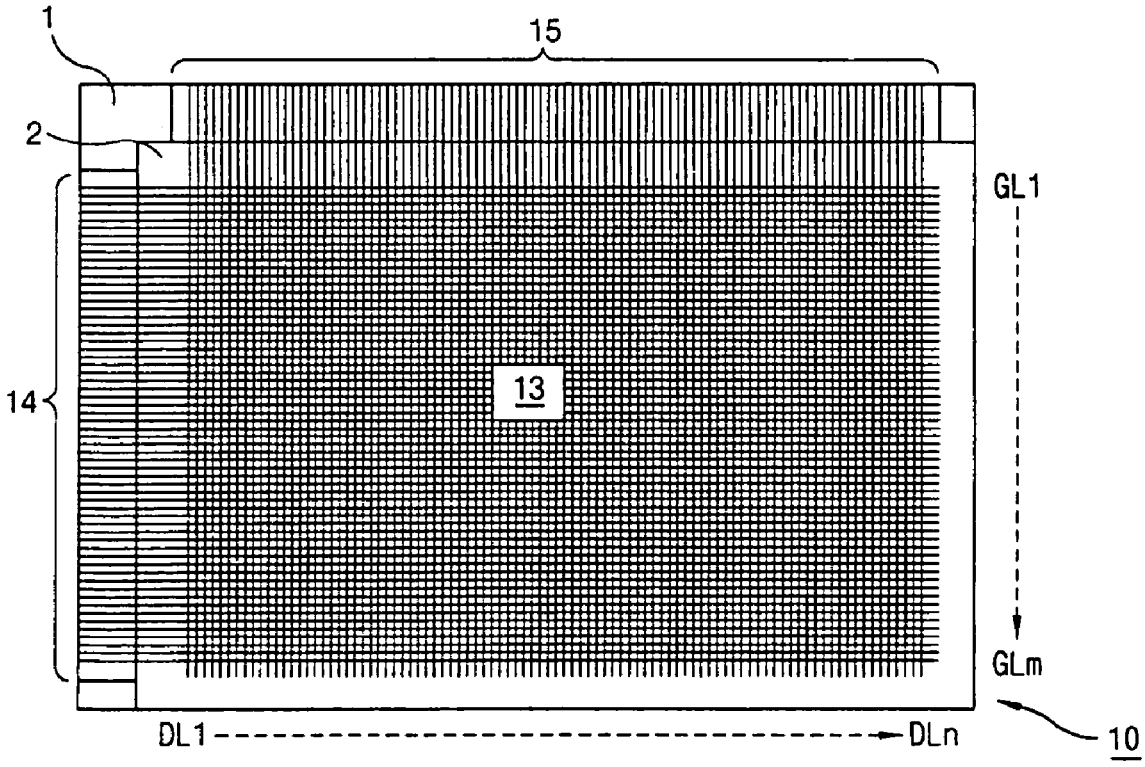
FIG.2 RELATED ART
FIG. 2 illustrates a schematic layout of an individually cut unit liquid crystal display panel according to a related art.
Figure 3:
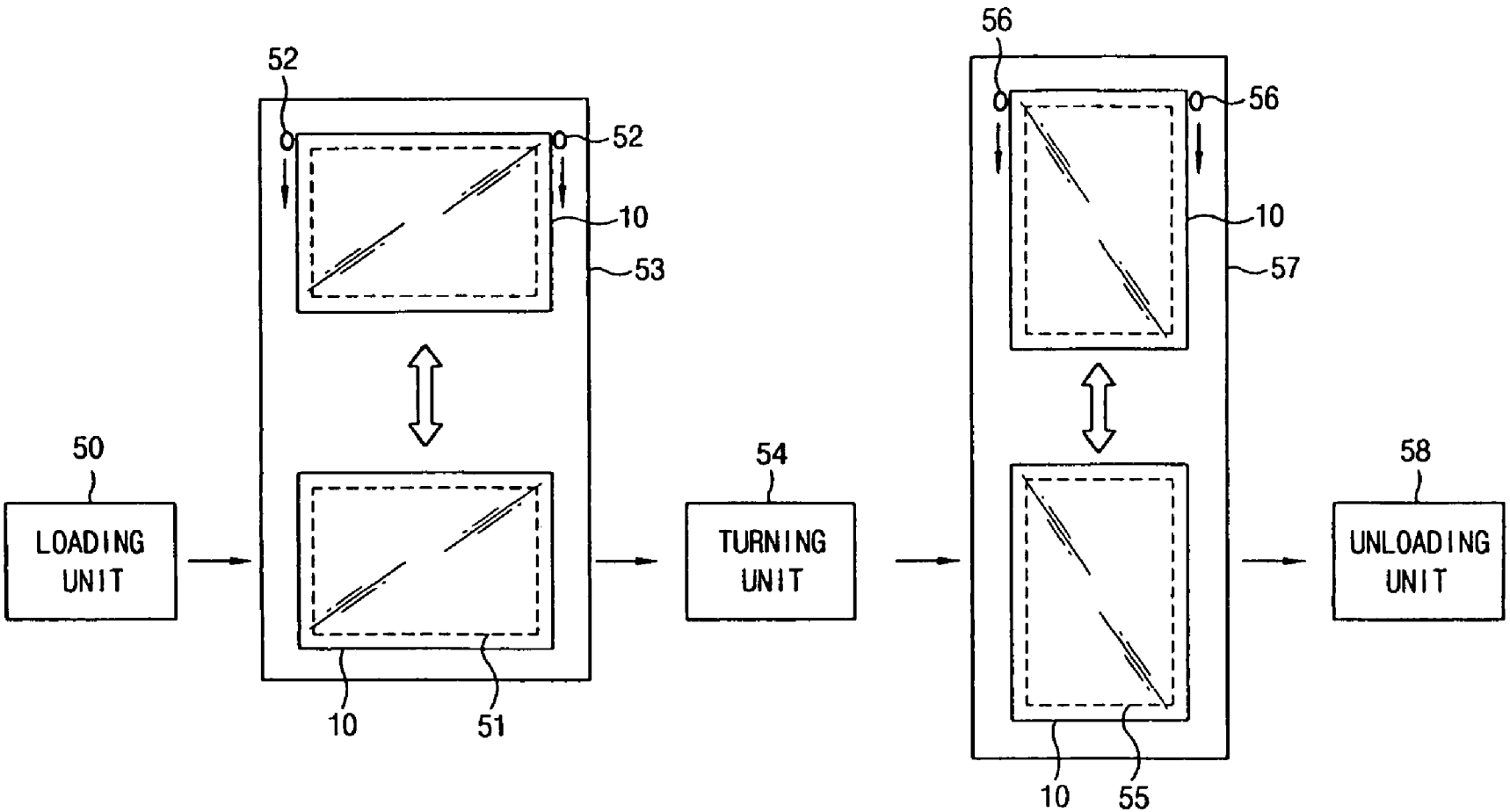
FIG.3 RELATED ART
FIG. 3 illustrates a block diagram of a device for grinding a liquid crystal display panel according to a related art.
Figure 4:
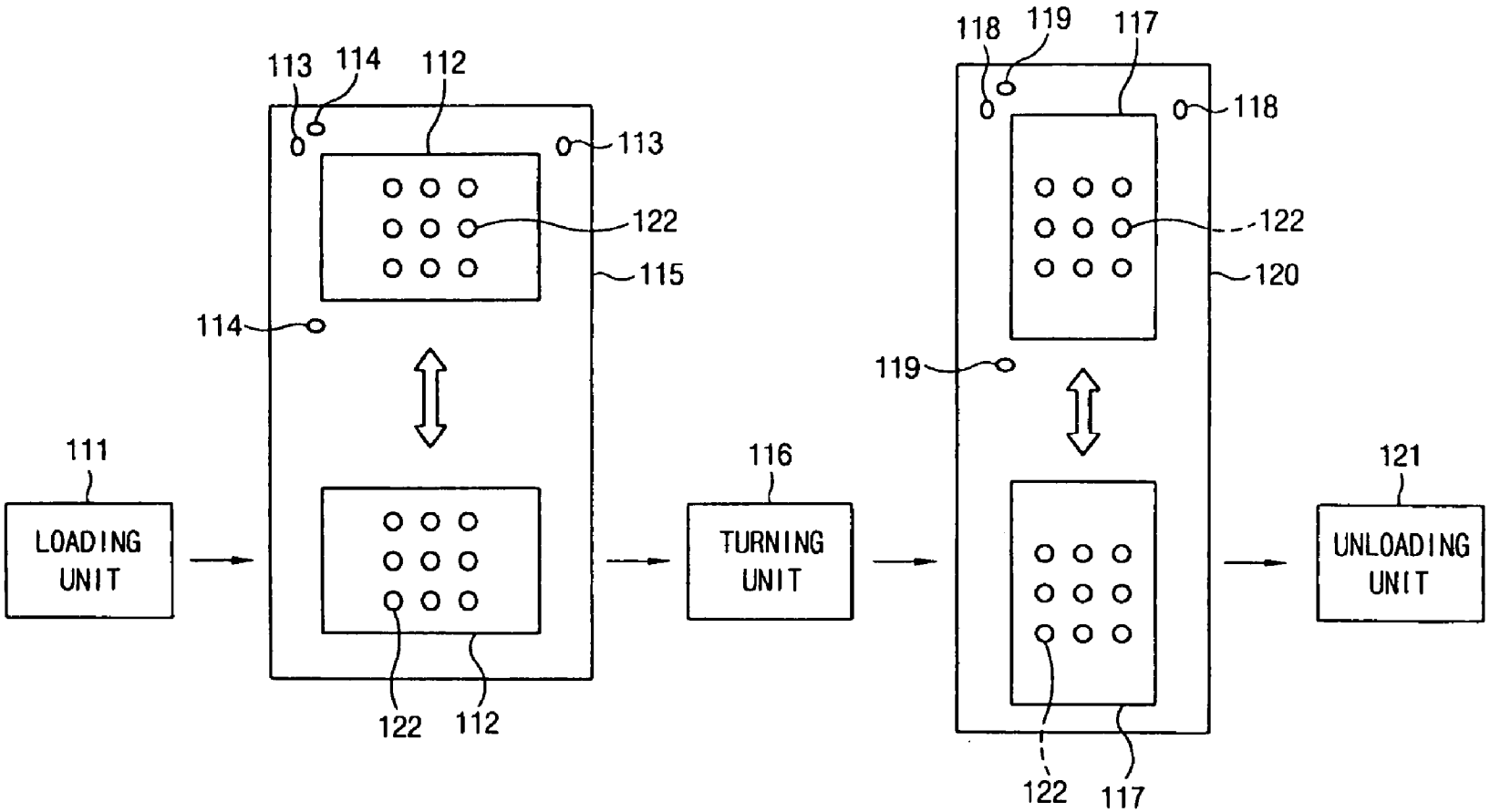
FIG. 4 illustrates a block diagram of a device for grinding a liquid crystal display panel according to one embodiment of the present invention.

FIG. 4 illustrates a block diagram of a device for grinding a liquid crystal display panel according to one embodiment of the present invention.

Referring to FIG. 4, a device for grinding a liquid crystal display panel according to one embodiment of the present invention includes a loading unit 111 loading a liquid crystal display panel, and a first grinding unit 115 receiving the unit liquid crystal display panel on a first grinding table 112 and grinding edges of short sides of the unit liquid crystal display panel through a first grinding wheel 113 in a normal mode. The first grinding unit can also grind the edges of the short sides and edges of long sides of the unit liquid crystal display panel through the first grinding wheel 113 and a second grinding wheel 114, respectively, in an emergency mode. The device for grinding also includes a turning unit 116 turning the unit liquid crystal display panel by 90° after the edges of the short sides have been ground in the first grinding unit 115, in the normal mode; a second grinding unit 120 receiving the unit liquid crystal display panel turned by the turning unit 116 and grinding the edges of the long sides of the unit liquid crystal display panel through a third grinding wheel 118 in the normal mode. The second grinding unit can also grind the edges of the long and short sides of the unit liquid crystal display panel through the third grinding wheel 118 and a fourth grinding wheel 119 respectively in the emergency mode; and an unloading unit 121 receiving the unit liquid crystal display panel after the edges of the short and long sides have been ground by the first and second grinding units 115 and 120 in the normal mode or by the first and second grinding units 115 and 120 in the emergency mode.

A plurality of suction holes 122 for absorbing the unit liquid crystal display panel effectively by suction are preferably formed on surfaces of the first and second grinding tables 112 and 117 of the first and second grinding units 115 and 120, respectively.

Operation of the device for grinding the liquid crystal display panel according to one embodiment of the present invention is explained in detail as follows.

Figure 5:
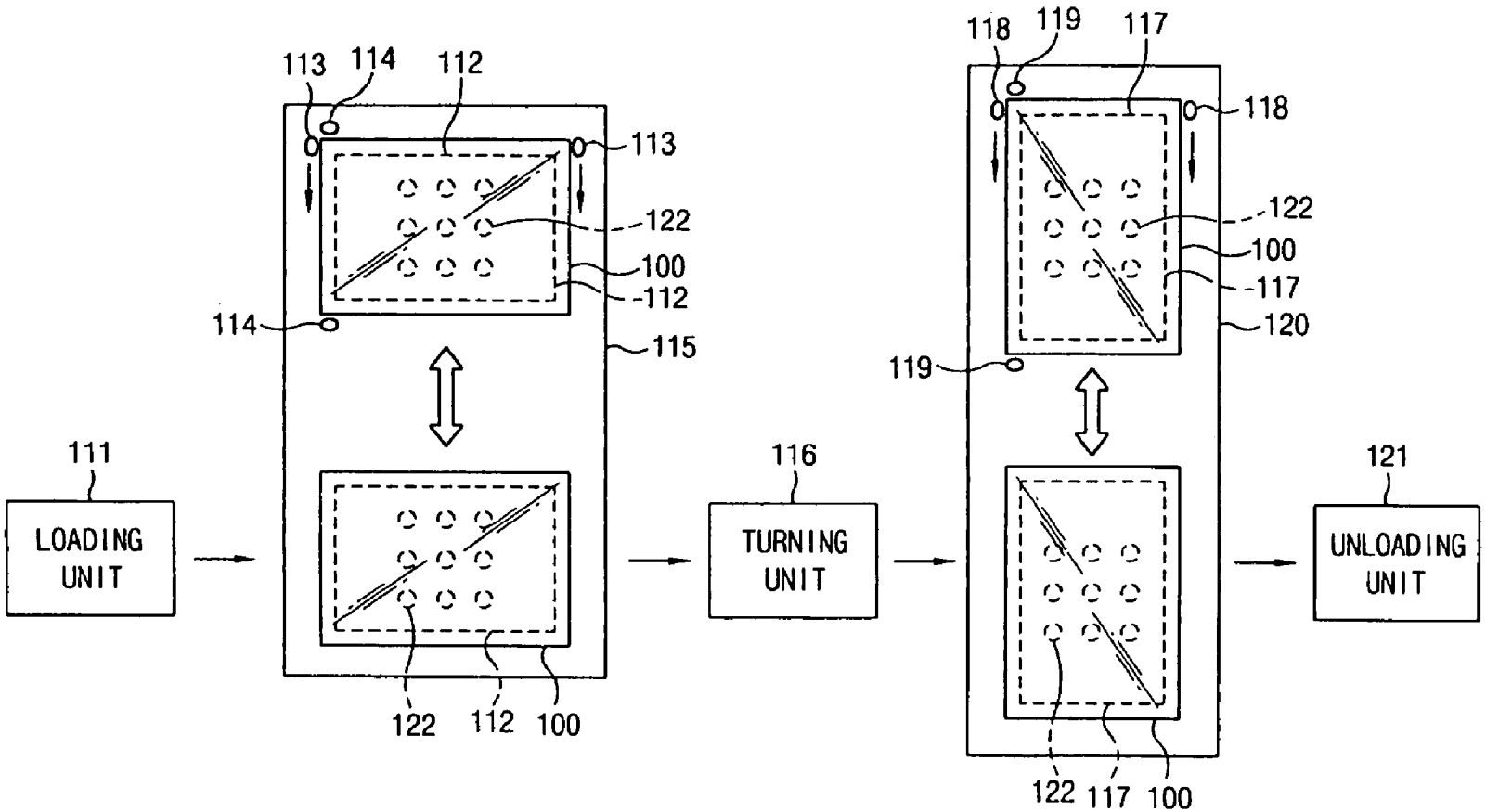
FIG. 5 illustrates a block diagram of a device for grinding a liquid crystal display panel in FIG. 4 for explaining operation of the device in a normal mode.

FIG. 5 illustrates a block diagram of a device for grinding a liquid crystal display panel in FIG. 4 for explaining operation of the device in a normal mode. Operation of the device of the present embodiment to grind the liquid crystal display panel in a normal mode is the same as operation of the device according to the related art.

Namely, the first grinding unit 115, as shown in FIG. 5, receives the unit liquid crystal display panel 100 loaded on the loading unit 111 to align on the first grinding unit 115, and then grinds the edges of the short or long sides of the unit liquid crystal display panel 100. In the embodiment of the present invention, the edges of the short sides of the unit liquid crystal display panel 100 are ground.

The turning unit 116 turns the unit liquid crystal display panel 100 by 90° after the short sides have been ground by the first grinding unit 115.

Subsequently, the second grinding unit 120 receives the unit liquid crystal display panel 100 turned by the turning unit 116 to align on the second grinding table 117 and then grinds the edges of the long or short sides of the unit liquid crystal display panel 100 that were not ground by the first grinding unit 115 through the third grinding wheel 118. In this embodiment of the present invention, the edges of the long sides of the unit liquid crystal display panel 100 are ground.

In another embodiment, the long sides may be ground first by the first grinding unit and then the short sides may be ground by the second grinding unit.

Thereafter, the unloading unit 121 unloads the unit liquid crystal display panel 100.

Yet, if the first or second grinding unit 115 or 120 is broken or malfunctions, the device for grinding the unit liquid crystal display panel according to the embodiment of the present invention is driven in the emergency mode.

Figure 6:
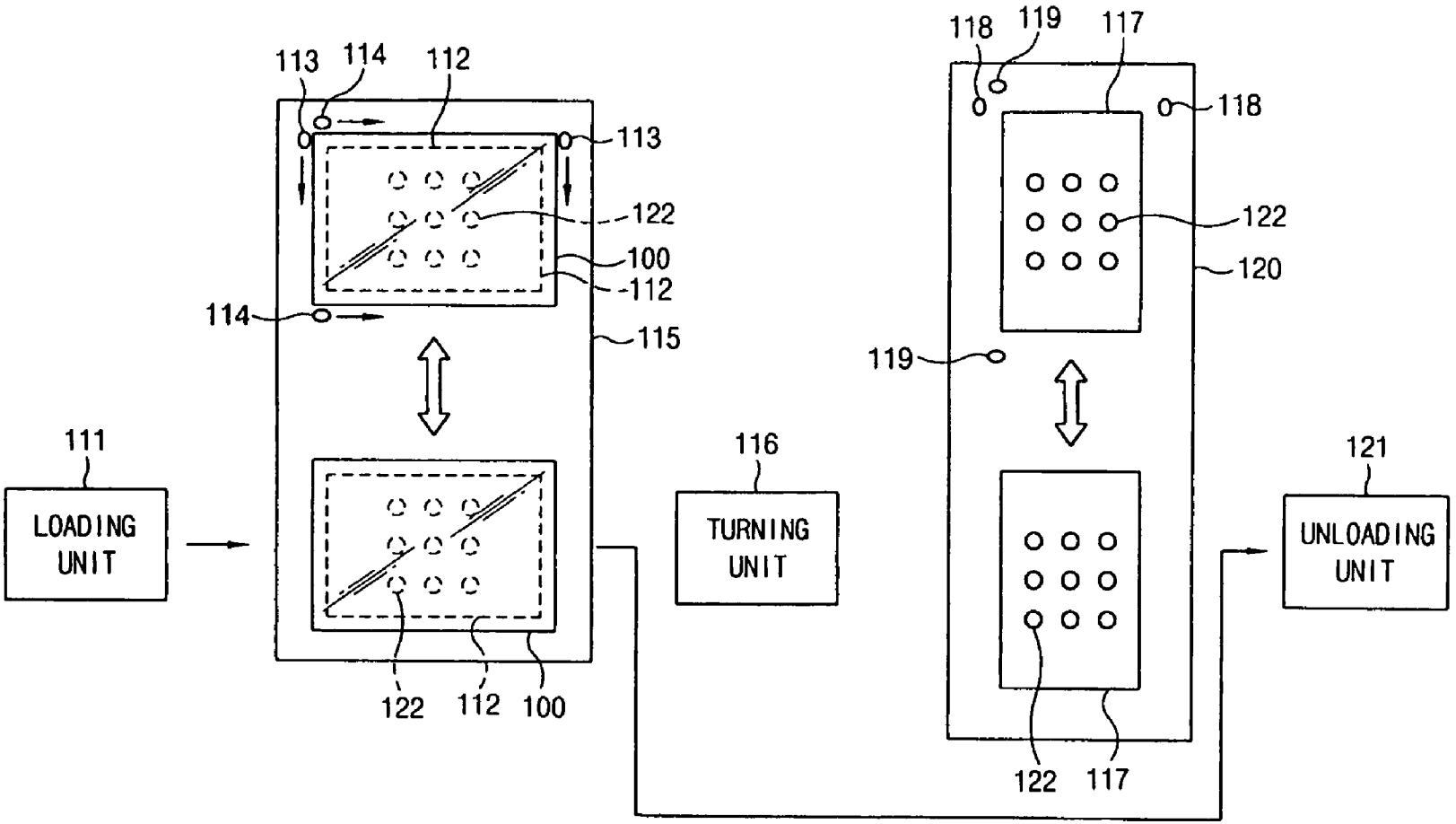
FIG. 6 illustrates a block diagram of a device for grinding a liquid crystal display panel in FIG. 4 for explaining operation of the device in an emergency mode when a second grinding unit is broken or malfunctions.

FIG. 6 illustrates a block diagram of a device for grinding a liquid crystal display panel in FIG. 4 for explaining that the device operates in an emergency mode when a second grinding unit is broken or malfunctions.

Referring to FIG. 6, the first grinding unit 115 receives the unit liquid crystal display panel 100 loaded on the loading unit 111 to align the liquid crystal display panel 100 on the first grinding table 112, and then grinds the edges of the short and long sides of the unit liquid crystal display panel 100 through the first and second grinding wheels 113 and 114.

Thereafter, the unloading unit 121 receives to unload the unit liquid crystal display panel 100 after the edges of the short and long sides have been ground by the first grinding unit 115.

Figure 7:
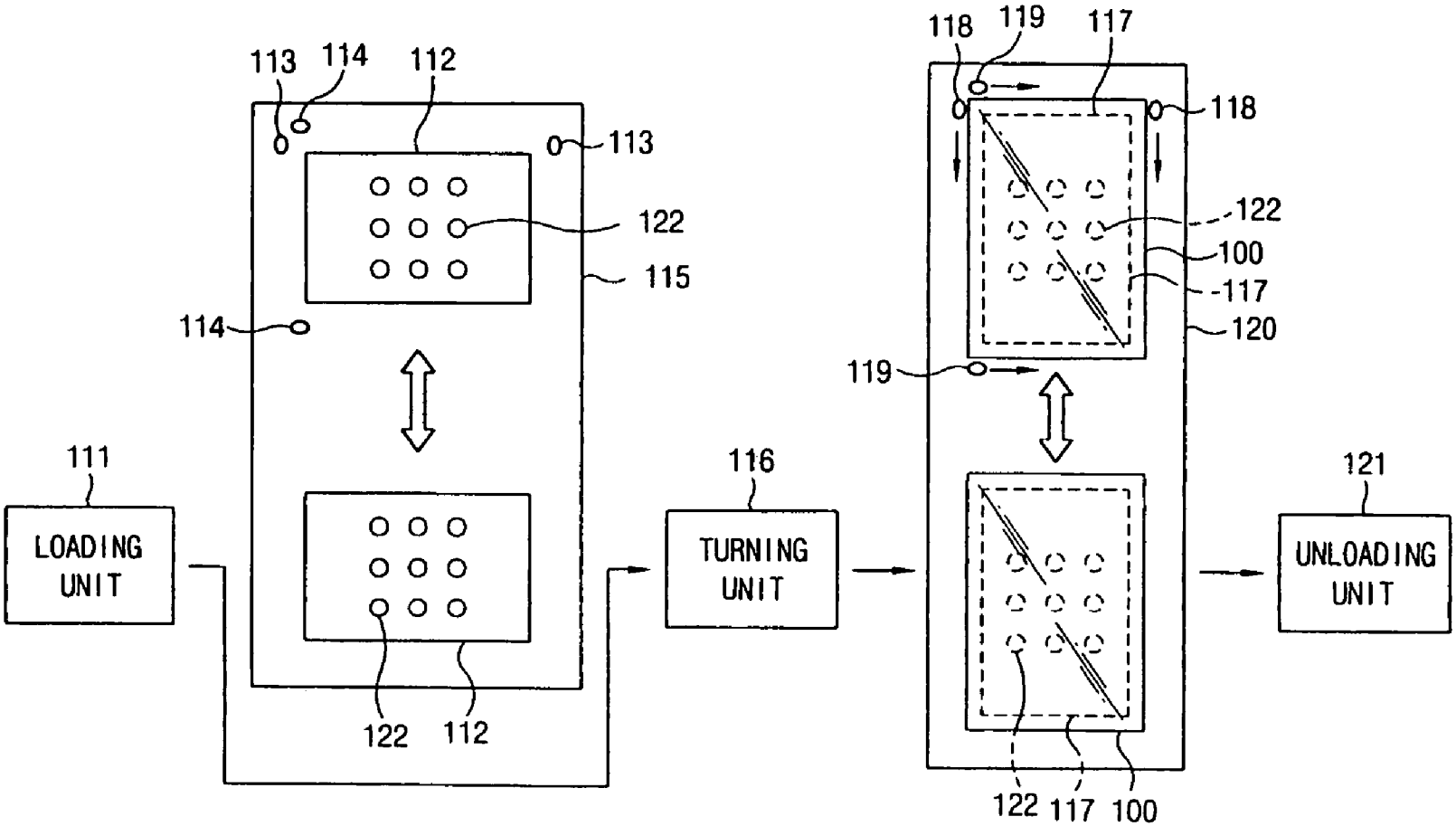
FIG. 7 illustrates a block diagram of a device for grinding a liquid crystal display panel in FIG. 4 for explaining operation of the device in an emergency mode when a first grinding unit is broken or malfunctions.

FIG. 7 illustrates a block diagram of a device for grinding a liquid crystal display panel in FIG. 4 for explaining that the device operates in an emergency mode when a first grinding unit is broken or malfunctions.

Referring to FIG. 7, the second grinding unit 116 receives the unit liquid crystal display panel 100 loaded on the loading unit 111 through the turning unit 116 to align unit liquid crystal display panel 100 on the second grinding table 117, and then grinds the edges of the long and short sides of the unit liquid crystal display panel 100 through the third and fourth grinding wheels 118 and 119.

Thereafter, the unloading unit 121 unloads the unit liquid crystal display panel 100 after the edges of the short and long sides have been ground by the second grinding unit 120.

Accordingly, when the device for grinding the unit liquid crystal display panel according to the present invention is operated in the normal mode, the first grinding unit grinds the edges of the long sides of the unit liquid crystal display panel and the second grinding unit grinds the edges of the short or long sides of the unit liquid crystal display panel that were not ground by the first grinding unit. Therefore, the present invention maximizes productivity.

Moreover, when the device for grinding the unit liquid crystal display panel according to the present invention is driven in the emergency mode if the first or second grinding unit is broken or malfunctions, the first or second grinding unit is able to grind the edges of the long and short sides of the unit liquid crystal display panel. Thus, the present invention can perform the grinding process through the normally operating second or first grinding unit even if the first or second grinding unit cannot be operated. Therefore, the present invention maximizes the use of the equipment, thereby improving productivity.

The forgoing embodiments are merely exemplary and are not to be construed as limiting the present invention. The present teachings can be readily applied to other types of devices. The description of the present invention is intended to be illustrative, and not to limit the scope of the claims. Many alternatives, modifications, and variations will be apparent to those skilled in the art.

What is claimed is:

1. A method of grinding a liquid crystal display panel comprising:

grinding a long side of the liquid crystal display panel with a first grinding unit; and grinding a short side of the liquid crystal display panel with a second grinding unit wherein the first grinding unit and the second grinding unit are configured to grind both the long side and the short side, wherein the first grinding unit includes a first pair of grinding wheels and a second pair of grinding wheels.

2. A method of grinding a liquid crystal display panel comprising:

grinding a long side of the liquid crystal display panel with a first grinding unit; and grinding a short side of the liquid crystal display panel with a second grinding unit wherein the first grinding unit and the second grinding unit are configured to grind both the long side and the short side, wherein the first grinding unit includes a first pair of grinding wheels and a second pair of grinding wheels, the first pair of grinding wheels grinding the long side of the liquid crystal display panel in a first mode and a second mode, the second pair of grinding wheels grinding the short side of the liquid crystal display panel in the second mode.

3. The method of claim 2, further comprising:

transferring the liquid crystal display panel to the first grinding unit and the second grinding unit in the first mode with a loading unit; and transferring the liquid crystal display panel to only the first grinding unit in the second mode with the loading unit.

4. The method of claim 2 further comprising:

turning the liquid crystal display panel by about 90° with a turning unit wherein edges of the long or short sides are ground by the first grinding unit in the second mode.

5. The method of claim 2, further comprising:

unloading the liquid crystal display panel from one of the first grinding unit and the second grinding unit with an unloading unit.

6. The method of claim 2, wherein the second grinding unit is non-functional in the second mode.

7. A method of grinding a liquid crystal display with a device having a first grinding unit and a second grinding unit, the first grinding unit having a first grinding wheel and a second grinding wheel, the method comprising:

grinding a long side of the liquid crystal display with the first grinding wheel; and grinding a short side of the liquid crystal display with the second grinding wheel in a first mode, wherein the first grinding unit includes a first pair of grinding wheels and a second pair of grinding wheels.

8. A method of grinding a liquid crystal display with a device having a first grinding unit having a first grinding wheel and a second grinding wheel, the method comprising:

grinding a long side of the liquid crystal display with the first grinding wheel; and grinding a short side of the liquid crystal display with the second grinding wheel in a first mode, wherein the first grinding unit includes a first pair of grinding wheels and a second pair of grinding wheels, wherein the device further includes a second grinding unit having a third grinding wheel and a fourth grinding wheel where the third grinding wheel grinds the short side of the liquid crystal display and the fourth grinding wheel grinds the long side of the liquid crystal display.

9. The method of claim 8, wherein the first grinding unit grinds the long side of the liquid crystal display in a second mode and the second grinding unit grinds the short side of the liquid crystal display in the second mode.

10. The method of claim 8, further comprising:

transferring the liquid crystal display to the first grinding unit in the first mode with a loading unit; and transferring the liquid crystal display to one of the first and second grinding units in the second mode with the loading unit.

11. The method of claim 8, further comprising:

turning a liquid crystal display by about 90° with a turning unit wherein edges of the long or short sides are ground by the first grinding unit in the first mode.

12. The method of claim 8, further comprising:

unloading the liquid crystal display from one of the first grinding unit and the second grinding unit with an unloading unit.

13. The method of claim 8, wherein the second grinding unit is not functional in the first mode.

14. A method of grinding a liquid crystal display with a device having a first grinding unit and a second grinding unit, the method comprising:

grinding a long side of the liquid crystal display with the first grinding unit;

grinding a short side of the liquid crystal display with the second grinding unit, the first grinding unit and the second grinding unit being configured to grind both the long side and the short side of the liquid crystal display, wherein the first grinding unit includes a first pair of grinding wheels and a second pair of grinding wheels.

15. A method of manufacturing a liquid crystal display (LCD) device, comprising:

preparing a first substrate and a second substrate;

applying liquid crystal to one of the first and second substrate;

attaching the first and second substrates to form a liquid crystal display panel;

grinding first opposing edges of the liquid crystal display panel in a first grinding unit, wherein the first grinding unit includes a first pair of grinding wheels and a second pair of grinding wheels;

grinding second opposing edges of the liquid crystal display panel in a second grinding unit, wherein the second grinding unit includes dual grinding wheels; and grinding first and second edges of the liquid crystal display panel in the first grinding unit if the second grinding unit is not functional.

* * * * *